US007810644B2

(12) United States Patent
Fraillon

(10) Patent No.: US 7,810,644 B2
(45) Date of Patent: Oct. 12, 2010

(54) CONTAINER WITH PIVOTING INTERMEDIATE SUPPORT

(75) Inventor: Patrick Fraillon, Mamaroneck, NY (US)

(73) Assignee: Alcan Packaging Beauty Services, Gennevilliers, Gtsmvr ( * ) Notice: Subject to any disclaimer, the term of this patent is extended or adjusted under 35 U.S.C. 154(b) by 161 days.

(21) Appl. No.: 11/615,264

(22) Filed: Dec. 22, 2006

(65) Prior Publication Data

US 2007/0175893 A1 Aug. 2, 2007

Related U.S. Application Data

(60) Provisional application No. 60/763,363, filed on Jan. 31, 2006.

(30) Foreign Application Priority Data

Jan. 31, 2006 (FR) ..... 06 00853

(51) Int. Cl.
*A45D 33/00* (2006.01)
*B65D 69/00* (2006.01)

(52) U.S. Cl. ..... 206/581; 206/823; 206/759; 220/23.89; 220/23.83; 220/23.87; 132/295

(58) Field of Classification Search ..... 206/581, 206/557, 567, 23.83, 23.86–23.89, 823, 759, 206/762, 765, 766, 566, 301, 18, 6.1; 132/293–296, 132/314, 315; 220/23.83, 23.86, 23.87, 23.88, 220/23.89

See application file for complete search history.

(56) References Cited

U.S. PATENT DOCUMENTS 1,489,788 A * 4/1924 Reid ..... 132/296
1,518,594 A * 12/1924 Marble ..... 132/295
1,525,943 A * 2/1925 Marble ..... 132/295
1,860,694 A * 5/1932 Shields ..... 132/295
1,957,157 A * 5/1934 Bosch ..... 206/752
1,993,417 A * 3/1935 Smith ..... 206/759
2,399,997 A * 5/1946 Flaster ..... 132/300
2,570,314 A * 10/1951 Brand ..... 132/304
3,476,123 A * 11/1969 Flax ..... 132/315
3,669,300 A * 6/1972 Thomas ..... 220/832
5,437,294 A * 8/1995 Ebbets et al. ..... 206/581
5,711,428 A * 1/1998 Ho ..... 206/759
6,070,749 A * 6/2000 Joulia ..... 206/581
6,076,679 A * 6/2000 Yuhara et al. ..... 206/581

* cited by examiner

*Primary Examiner*—Ehud Gartenberg
*Assistant Examiner*—Andrew Perreault
(74) *Attorney, Agent, or Firm*—Dennison, Schultz & MacDonald

(57) ABSTRACT

Container (1) designed to hold cosmetic products including a lid (10) typically equipped with an interior mirror (60) and a base (20) equipped with an intermediate support (30) with two faces, front and back, surrounded by a frame (31). The frame (31) of the intermediate support is equipped with a first attachment device (34) which cooperates with a second attachment device (23) positioned on the base so that, when the intermediate support is detached from the base, it remains part of the base due to the cooperation of the first and second attachment devices (34 and 23), and is able to pivot around the first attachment device. Preferably, the first attachment device (34) is a protuberance equipped with an end fold (33) and the second attachment device (23) is a hollow body capable of accommodating and containing the end fold. The two faces of the intermediate supports are advantageously equipped with a plurality of compartments.

20 Claims, 3 Drawing Sheets

CONTAINER WITH PIVOTING INTERMEDIATE SUPPORT

This application claims the benefit of provisional application 60/763,363, filed Jan. 31, 2006.

FIELD OF THE INVENTION

The invention relates to the field of the packaging of cosmetic products, and more particularly that of containers holding facial care products, typically in the form of gels, powders, pressed or not, mousses or creams.

DESCRIPTION OF RELATED ART

The containers of the invention are for the packaging of cosmetic products that are generally flat in shape, their function being to offer the user a large surface of product at all times so that it is easier to pick up some product using the finger or an applicator. This surface, which is substantially flat, will be referred to hereinafter as the distribution surface.

In general, these containers typically comprise a dished lid generally equipped with a mirror inside and a hollow base whose cavity sometimes holds the cosmetic product directly. However, especially to make it easier to replace the cosmetic product with a recharge, the cavity is not filled directly but is designed to hold an intermediate support, also called a "divider" or "platform," fitted such that it may house one or more compartments (preferably interchangeable) filled with cosmetic product. The base generally has a peripheral edge surrounding a cavity designed to hold the intermediate support.

The lid may surround the base like a sheath, but more generally, the lid pivots on a hinge that is positioned at the edge of the base and the lid and which forms the connecting element between the lid and the base. This hinge permits the lid to pivot and the container to be opened. The lid and the base are equipped with additional means for locking and unlocking the lid with respect to the base, so as to open and close the container. These means are for example simple reversible means of forming a one piece unit, such as a notch—fold unit or a fold—fold unit, or even the elements of an extra part called a "clasp." This clasp, generally located opposite the hinge of the container, is usually formed by the cooperation of one element of the lid with one element of the base clasp or the divider attached to the base, in order to ensure that the container will remain closed at all times except when the user opens it intentionally.

Many forms of containers are known, forms which may use one or more components of the container, in particular the mechanisms associated with the relative movements of the lid and the base when the container is opened or closed, those relative to the safe and tight closure of the container but also those concerning the internal and external fittings of the container, which permit for example the cosmetic product to be viewed directly when the container is closed, in particular when it is exhibited for sale. Thus, we can mention:

- FR 2 661 080, which describes a compact make up container with a compact clasp;
- FR 2 725 958, which relates to an articulated opening container with assisted opening system;
- FR 2 737 192, which describes a container with a pivoting lid fitted with a flexible hinge;
- FR 2 844 434, which describes a container with a lateral clasp;
- FR 0 848 868 which describes a container whose lid is equipped with a pivoting panel permitting for example a mirror positioned on the outside face of the closed container lid moving when the container is opened so that it is positioned on the inside face of the lid; and
- EP 0 614 628, which takes up the idea of FR 0 848 868 and describes a container whose bottom is the base where the lid is fitted with, instead of a mirror, a pivoting panel equipped with compartments filled with cosmetic products.

One problem is to offer the users containers that are different from the containers of the state of the art, and in particular to offer containers which alone permit the users to carry all of the cosmetic products they need. Some containers are equipped with dividers with a number of compartments filled with various cosmetic products. However, due to the required spread of the distribution surface and the limited size necessary for a container (it must be easy to handle, fit into a handbag, etc.), the number of such compartments is obviously limited.

The applicant has therefore sought a means to increase the number of cosmetic products offered in a single container, without reducing the ergonomics of the distribution or modifying the size of the container, while still maintaining the protection of all the cosmetic products from attacks from the external environment of the container (oxidation, drying, soiling, etc.).

SUMMARY OF THE INVENTION

One first purpose of the invention is to provide a container designed to package cosmetic products for facial care, typically in the form of gels, powders, pressed or not, mousses or creams, the container comprising a lid typically equipped with an interior mirror and a base equipped with an intermediate support with two faces (front and back) surrounded by a frame, characterised in that the frame of the intermediate support is equipped with a first attachment means which cooperates with a second attachment means positioned on the base so that when the intermediate support is detached from the base, it remains joined to it due to the cooperation of the first and second attachment means, while still being able to pivot around the first attachment means.

The first attachment means and the second attachment means cooperate with one another so that one of them cannot move in one direction but can still move in the other directions. For example this may be a fold—hollow housing unit where the fold is held inside the hollow housing, the latter being of large volume, typically twice that of the fold, to permit the latter to keep some movement in all directions provided that it doesn't come into contact with the wall of the hollow housing. Advantageously, the first attachment means, associated to the intermediate support, is a protuberance equipped with an end fold and the second attachment means, associated to the base is a hollow body capable of accommodating and holding the end fold.

The protuberance is for example a pin that is typically cylindrical equipped with an end fold or enlargement that is typically spherical with a diameter greater than the diameter of the pin and the hollow body comprises a wall that has a slot into which the pin is inserted and along which it can move. Advantageously, the slot is situated on the hollow body so that the pin can pivot in a plane that is perpendicular to the distribution surface (which is typically parallel to the plane of the bottom of the container base) so that it can form, with the plane of the distribution surface, an angle $\alpha$ anywhere between 0° and 90°. Furthermore, the length of the pin is defined so that, for a tilt angle $\alpha 0$ of less than 90°, typically between 50° and 80° (corresponding for example to the angle which provides the best handling ergonomics of the intermediate support), the intermediate support can rotate through 180° around the axis of the pin. The optimal tilt angle $\alpha 0$ depends on the geometry of the intermediate support and must be defined so that there is no risk of collision between the peripheral wall of the intermediate support and part of the base or the lid during the rotation.

The invention is of particular interest if each of the two faces (front and back) of the intermediate support is equipped with compartments designed to hold a cosmetic product: the intermediate support, in a first configuration, has a first face with a first plurality of compartments filled with cosmetic products then, after being placed in a geometrical configuration so that it can pivot through 180° around the pin of its protuberance while remaining attached to the base, has a second face, opposite to the first face, with a second plurality of compartments. In this way, there is double the choice offered to the user with the same volume of container. The second face may also be equipped with an instrument for applying cosmetic products, such as a brush, attached by magnetic or mechanical means.

In the preferred embodiments of the invention, the base has a bottom and a peripheral edge which surrounds a cavity acting as a housing for the intermediate support. The side wall of the cavity has a form that is complementary to that of the peripheral wall of the intermediate support, so that the intermediate support is immobile with respect to the base when it is housed in the cavity of the base. Advantageously, the second attachment means is a hollow body positioned on the side wall of the cavity.

The intermediate support can be held inside the cavity by reversible attachment means, typically reversible ratchet means (raised sections in the shape of grains of rice of a low amplitude cooperating with the folds, cavities, etc.) respectively positioned on the peripheral wall of the intermediate support and on the side wall of the cavity. Preferably, the reversible attachment means are respectively positioned on the frame of the intermediate support and on the side wall of the cavity so that they can cooperate regardless of the face of the intermediate support that is exposed.

Also preferably, the intermediate support is equipped with a tab or a raised section that makes it easier to extract it from the cavity, the raised section being positioned opposite the protuberance. This raised section may also be used as a raised section for gripping it, making the intermediate support easier to handle when it is rotated through 180°. In the case of the intermediate support being held inside a cavity, the side wall of the cavity is equipped with a housing capable of accommodating the raised section. In order for this raised section to be efficient in terms of gripping means, it must be sufficiently large in size and it is advantageous to limit the size of the container, to make this housing open, which is to say to equip the peripheral edge of the container with a slot capable of accommodating the raised gripping section.

The intermediate support, housed in the cavity of the base, thus has a first plurality of compartments filled with cosmetic products. The first and second attachment means cooperate so that the intermediate support, positioning a first face to the user when the container is opened, can be removed from the cavity of the base, then placed in a geometrical configuration so that it can pivot through 180° around the pin of its protuberance and finally be reinserted into the cavity, presenting the second face to the user. In this way, in order to obtain access to the plurality of cosmetic products, contained in the compartments of the other face of the intermediate support, the user can:

a) detach the intermediate support by means for example, of the raised section or the tab mentioned above, b) hold the intermediate support preferably by the part of its peripheral wall located on the opposite side to the first attachment means, c) raise this part of the peripheral edge so that the axis of the pin is tilted with respect to the distribution surface, which permits it to turn the intermediate support around its axis through 180° and, d) once the rotation has been carried out, reduce the tilt angle of the pin axis so that the intermediate support can once again be inserted into the cavity, by presenting this time its second face, equipped with the second plurality of compartments.

The hollow body of the second attachment means can be carried out simply: an open hollow part is put into position and fixed, resting against the wall of the base cavity. The open hollow part presents for example one front wall, two side walls and a top wall. The front wall is fitted so that its end face is at least partially in contact with the bottom of the cavity. It is equipped with the slot which opens onto its end face, thus permitting the pin of the protuberance to pass when the open hollow part is positioned on the base, the open hollow part being positioned so that it covers the end fold of the protuberance.

The open hollow part is fixed and held against the bottom and the side wall of the cavity by clips or any other assembly means, such as ultrasonic welding, gluing, friction, etc. For example, for clipping, the two side walls of the open hollow part are equipped with attachment means, such as folds or grains of rice which cooperate with the complementary attachment means fitted on the side wall of the cavity.

In one preferred embodiment of the invention, the lid and the base are connected to one another by a hinge and the peripheral edge of the base is equipped with two slots positioned symmetrically with respect to the median plane of the hinge, so that the intermediate support equipped with its raised gripping section can be turned to either side of the hinge depending on whether the user is left or right handed. In this case, the open hollow part is advantageously equipped with a projection that has a shape similar to that of the raised gripping section of the intermediate support and which is positioned so that the hollow part is attached to the base, it is housed in the slot that is not used to house the raised gripping section of the intermediate support.

The position of the first and second attachment means is preferably selected to respect the symmetry of the container. In this way, when the lid and the base are connected to one another by a hinge and the base is fitted with a locking/unlocking system situated opposite the hinge, substantially in the median plane of the hinge, the second attachment means is preferably positioned on the side wall of the cavity in the median plane of the hinge, on the hinge side or even in a plane parallel to the hinge, halfway between the hinge and the locking/unlocking system.

When the lid and the base are connected to one another by a hinge and the base is equipped with a locking/unlocking system positioned laterally, in a plane parallel to the hinge, the second attachment means is preferably positioned on the side wall of the cavity, substantially in the plane parallel to the hinge, on the opposite side to the locking/unlocking system or even on the side wall of the cavity in the median plane of the hinge.

When the container is globally rectangular in shape, the hinge and the locking/unlocking system are preferably positioned opposite one another on the large (respectively the small) sides of the rectangle and the second attachment means is positioned on a small (respectively a large) side of the rectangle. When the hinge and the locking/unlocking system are positioned opposite one another on the large (respectively the small) sides of the rectangle, the side wall of the base corresponding to the small (respectively to the large) side is equipped with at least one slot designed to accommodate the projection of the open hollow part.

Two specific embodiments of the invention will be described hereinafter with the aid of the appended figures.

DESCRIPTION OF THE PREFERRED EMBODIMENTS

EXAMPLE 1 (FIGS. 1, 2, 3, 4*a*, 4*b*, 4*c*)

Figure 1:
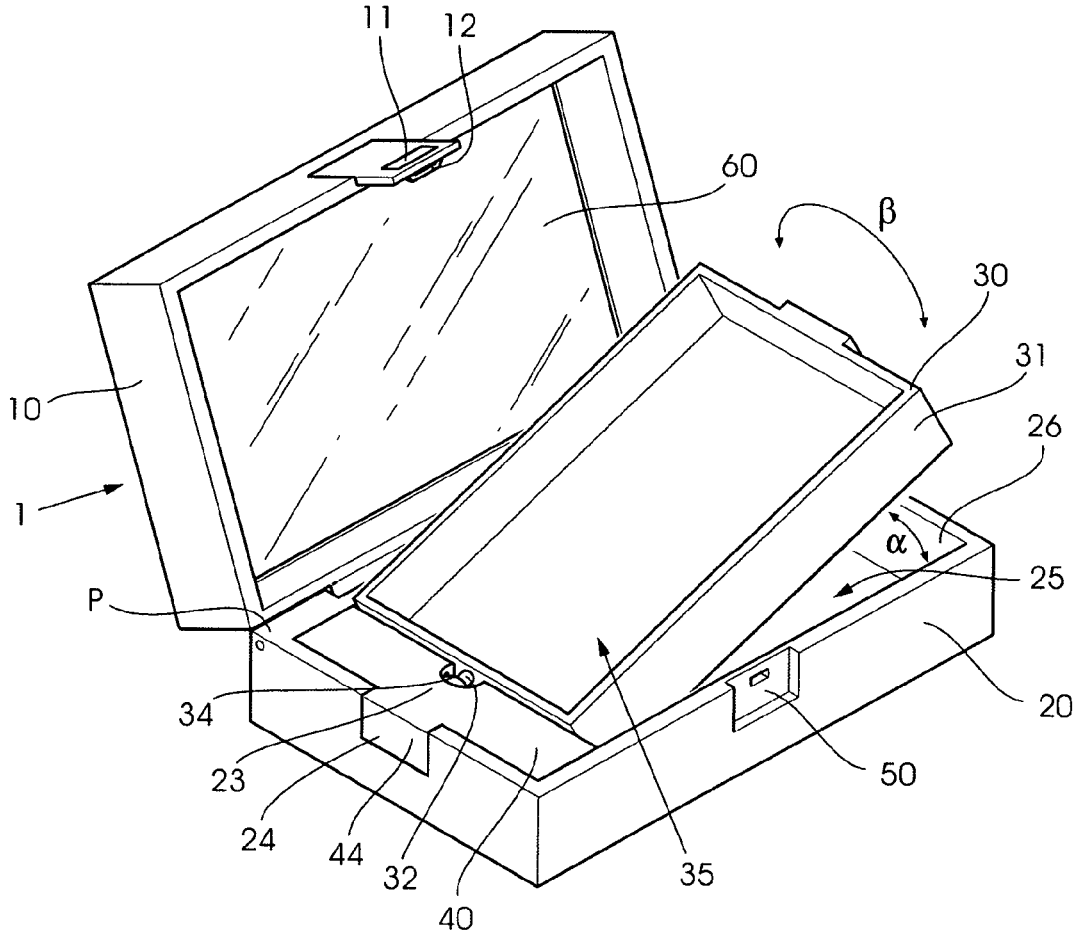
FIG. 1 shows in a perspective view a container according to the invention.
Figure 2:
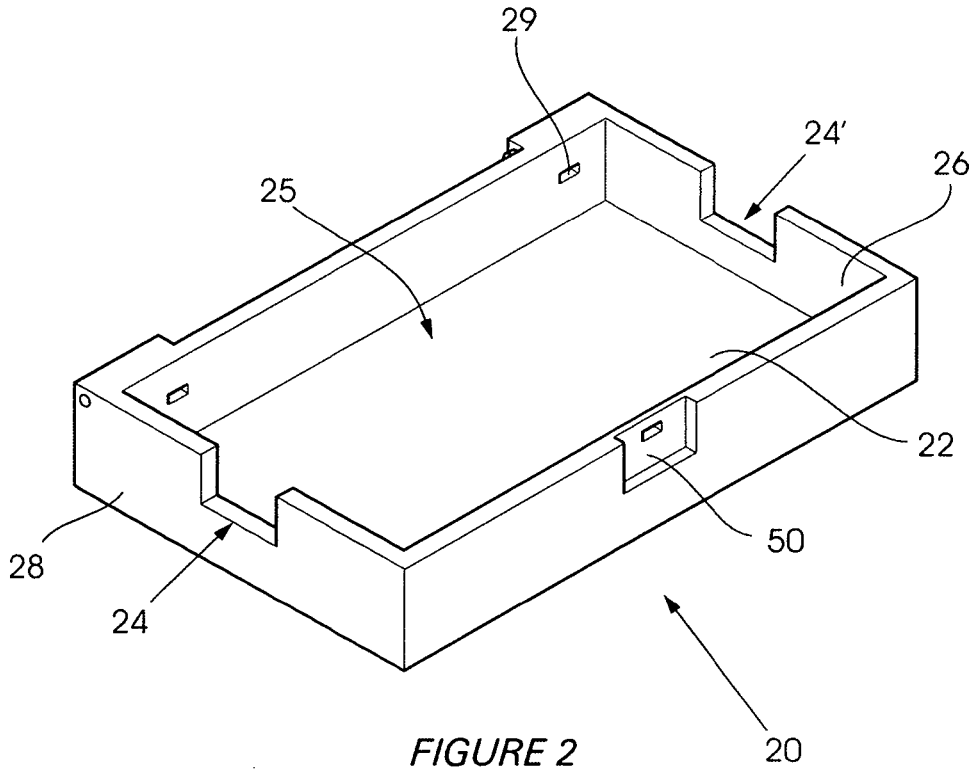
FIG. 2 shows in a perspective view the base of the container of FIG. 1.
Figure 3:
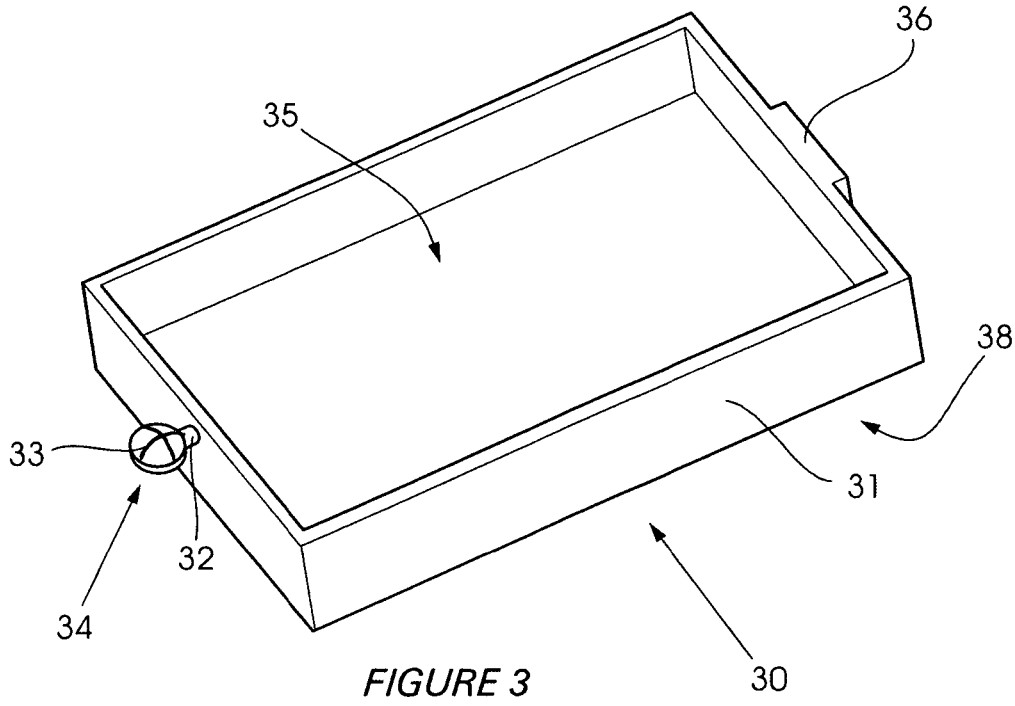
FIG. 3 shows in a perspective view the intermediate support inserted into the container of FIG. 1.
Figure 4:
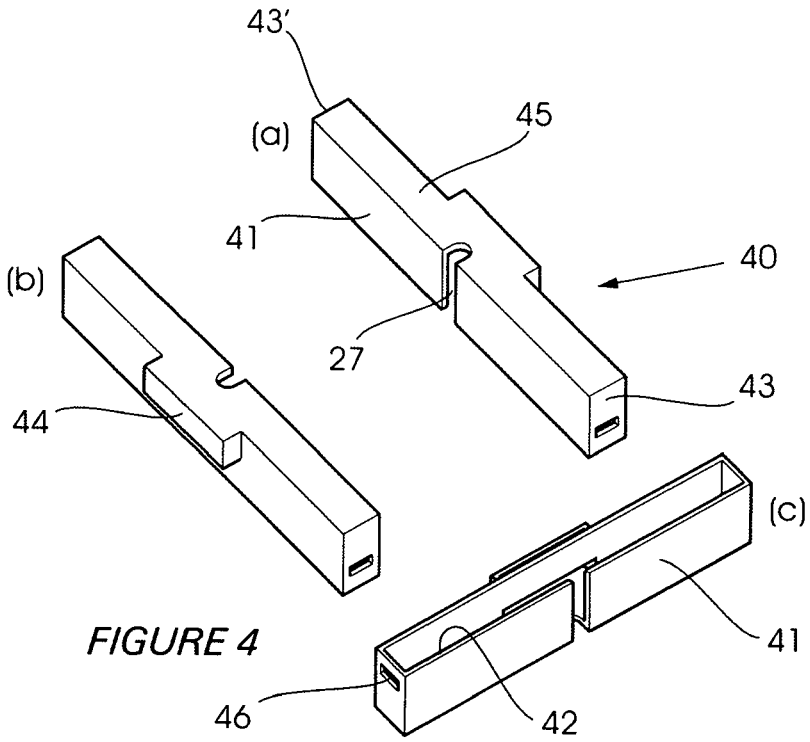
FIGS. 4*a*), 4*b*) and 4*c*) show in perspective views from three different angles, an open hollow part permitting, in conjunction with the cavity of the base of the container, the hollow body of the second attachment means of the container of FIG. 1 to be formed.

The container 1 illustrated in FIG. 1 comprises a lid 10 equipped with an interior mirror 60 and a base 20 equipped with an intermediate support 30 with two faces 35 and 38 front and back surrounded by a frame 31. Each face has four compartments (not shown), each designed to accommodate a different cosmetic product. The frame 31 of the intermediate support 30 is equipped with a first attachment means 34 which cooperates with a second attachment means 23 positioned on the base so that, when the intermediate support is extracted from the cavity, it remains attached to the base due to the cooperation of the first and second attachment means, while being able to pivot around the first attachment means.

The first attachment means, associated with the intermediate support, is a cylindrical pin 32 that is rather stubby, equipped with a spherical end fold 33. The second attachment means, associated to the base is a hollow body capable of accommodating and containing the end fold, comprising a wall 41 which has a slot 27 into which the pin is inserted and along which it can move. The slot 27 is positioned on the hollow body so that the pin 32 can pivot in a plane perpendicular to the plane P of the distribution surface (which is typically parallel to the plane of the bottom 22 of the base 20 of the container) so that it can form, with the plane of the distribution surface, and angle $\alpha$ of anywhere between 0° and 90°. The cylindrical pin 32 is rather stubby but its length is defined so that, for a tilt angle $\alpha 0$ which here is close to 70° and which permits the best handling ergonomics of the intermediate support, the intermediate support can rotate through 180° around the axis of the pin.

The intermediate support has two faces opposite one another each capable of being fitted with four compartments. In a first configuration it has a first face with four first compartments filled with cosmetic products, and then, after being placed in a geometrical configuration such that it can pivot through 180° around the pin of its protuberance while remaining attached to the base, has a second face, opposite to the first face, with four other compartments. In this way, the user has 8 compartments available instead of four with the same volume of container.

The base 20 has a bottom 22 and a peripheral edge 28 surrounding the cavity 25 that accommodates the intermediate support 30. The shape of the side wall 26 of the cavity 25 is complementary to that of the frame of the intermediate support, so that the intermediate support does not move with respect to the base when it is housed in the cavity of the base. The second attachment means 23 is a hollow body positioned on the side wall 26 of the cavity.

The intermediate support 30, housed in the cavity 25 of the base when it is in distribution configuration, thus has four compartments filled with cosmetic products. In order to have access to the other four cosmetic products, contained in the compartments on the other side of the intermediate support, the user detaches the intermediate support by means of the raised gripping section 36 positioned on the part of its frame 31 located opposite the first attachment means 34, raises this part of the peripheral edge so that the axis of the pin reaches an angle with respect to the distribution surface that allows it to turn the intermediate support around its axis through 180° and, once the rotation has been carried out, reduces the angle of the pin axis so that the intermediate support can once again be inserted into the cavity, this time presenting its second face, equipped with the other four compartments.

The hollow body of the second attachment means 23 is made simply: an open hollow part 40 is placed in position and clipped, in contact with the wall of the cavity 25 of the base 20. The open hollow part 40 has one front wall 41, two side walls 43 and 43' and a top wall 45. The front wall 41 is designed so that its end edge 42 comes into contact with the bottom 22 of the cavity 25. It is equipped with the slot 27 which opens out onto the end edge 42, thus permitting the pin 32 of the protuberance to pass when the open hollow part is moved into position on the base, the open hollow part being positioned so that it cover the end fold 33 of the protuberance. The top wall 45 is fitted so that it reaches to the plane P of the distribution surface after the open hollow part 40 is clipped into the cavity 25 of the container.

The side walls 43 and 43' come into contact with the side wall 26 of the cavity 25 when the open hollow part 40 is moved into position in the cavity 25. They are equipped with attachment means 46 which cooperate with the complementary attachment means 29 fitted on the lateral wall of the cavity.

The lid 10 and the base 20 are connected to one another by a hinge and the base is equipped on its peripheral edge 28 with two slots 24 and 24' positioned symmetrically with respect to the median plane of the hinge, so that the second attachment means 23 can be positioned on either side of the hinge, depending on whether the user is left or right handed. The open hollow part 40 is equipped with a projection 44 that has a shape similar to that of the raised gripping section 36 of the intermediate support 30 and which is positioned such that, when the hollow part is attached to the base, it is housed in the slot 24 which is not used to house the raised gripping section of the intermediate support.

The base 20 is equipped with a notch 50 positioned opposite the hinge, substantially in the median plane of the hinge and the second attachment means 23 is positioned on the side wall 26 of the cavity 25 in a plane parallel to the hinge, approximately halfway between the hinge and the clasp. The notch 50 cooperates with the fold 12 of the tongue 11 of the lid 10 to ensure that the container closes. This system may be replaced by a push button type clasp.

EXAMPLE 2 (FIG. 5)

Figure 5:
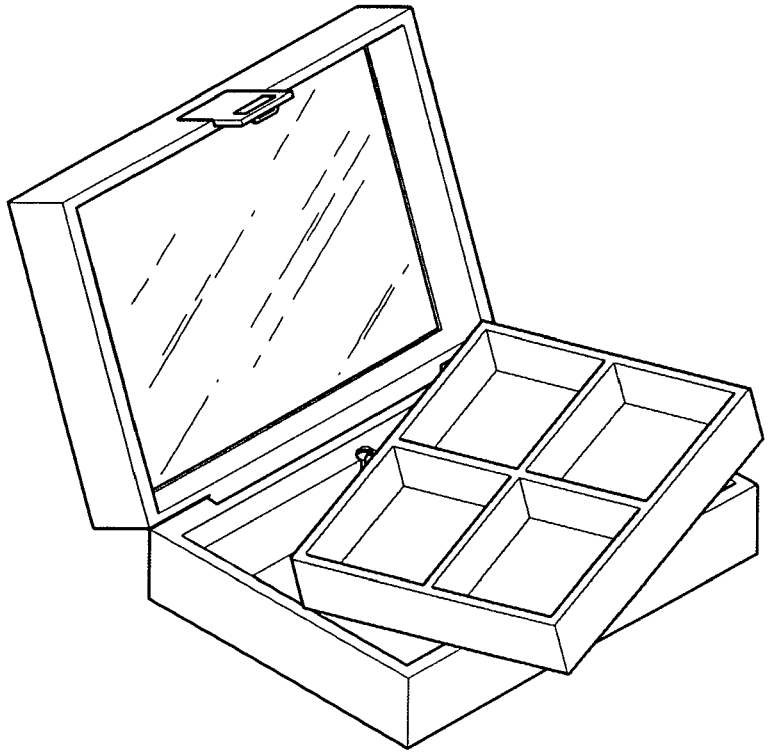
FIG. 5 shows in perspective view another container according to the invention.

The container shown in FIG. 5 is essentially different from the previous container in that the second attachment means is positioned on the side wall of the cavity in the median plane of the hinge, on the hinge side.

What is claimed is:

1. Container for a cosmetic product, the container comprising:

a rectangular base comprising a pair of opposed lateral walls, a pair of opposed transverse walls, and a floor defining therein a cavity;

a rectangular intermediate support comprising two opposed rectangular faces surrounded by a rectangular frame comprising a pair of opposed lateral walls and a pair or opposed transverse walls, the intermediate support being disposed within the cavity;

a lid which is constructed and arranged to selectively close to cover, and open to expose the cavity with intermediate support disposed therein; and a hinge connecting the base and the lid;

a transverse wall of the frame of the intermediate support being equipped with a first attachment means comprising an enlargement extending from a protuberance retained in the frame and extending laterally from the frame, the first attachment means cooperating with a second attachment means formed in a transverse wall of the base in the form of a hollow housing in which the enlargement is retained, the hollow housing being formed by an open hollow part disposed against a transverse wall of the base, the hollow housing comprising a pair of end walls contacting opposed lateral walls of the base, and an attachment means which cooperates with a complementary attachment means disposed in a transverse wall of the base, one said complementary attachment means being disposed in each of the opposed transverse walls of the base, thereby enabling the hollow housing to be disposed against either of the opposed transverse walls, wherein the intermediate support is removable from the base in an area opposite to the first attachment means, the intermediate support remaining joined to the base by the cooperating first and second attachment means, and being pivotable and rotatable around the first attachment means with the intermediate support removed from the base in the area opposite to the first attachment means.

2. Container of claim 1, wherein the hollow housing comprises at least one front wall having a slot and an end edge which comes into contact with the floor of the base, the slot opening out onto the end edge.

3. Container of claim 1, wherein the hollow housing has a volume which is double the volume of the enlargement.

4. Container of claim 1, wherein the hollow housing comprises a slot through which the protuberance passes, with the enlargement retained in the hollow housing.

5. Container of claim 4, wherein the protuberance is a cylindrical pin, and the enlargement is generally spherical, and has a diameter greater than that of the slot and the pin.

6. Container of claim 4, wherein the slot is positioned on the hollow housing such that the pin can pivot in a plane perpendicular to that of a surface for distribution of the cosmetic, forming thereby, between the frame and the floor of the base, an angle $\alpha$ of between 0° and 90°.

7. Container of claim 6, wherein the pin has a length defined such that, for a tilt angle $\alpha_0$ between the frame and the floor of the base of less than 90°, the intermediate support can rotate through 180° around the axis of the pin.

8. Container of claim 1, wherein each of the opposed faces of the intermediate support is equipped with at least one compartment constructed and arranged to hold at least one of a cosmetic product and an applicator.

9. Container of claim 8, wherein each face of the intermediate support has a plurality of compartments filled with cosmetic products, and the intermediate support is pivotable 180° to enable exposure of both faces.

10. Container of claim 1, wherein a side wall of the base has a shape which is complementary to that of a peripheral wall of the intermediate support, so that the intermediate support does not move with respect to the base when it is housed in the cavity.

11. Container of claim 10, wherein the intermediate support is retained in the cavity by means of cooperating reversible ratchet attachment means, located on the frame of the intermediate support and on the side wall of the base.

12. Container of claim 11, wherein the reversible attachment means are constructed and arranged to cooperate regardless of the face of the intermediate support that is exposed.

13. Container of claim 10, wherein the intermediate support is equipped with a raised gripping section to facilitate withdrawal of the intermediate support from the cavity, the raised section being positioned in the area opposite the first attachment means.

14. Container of claim 13, wherein a peripheral edge of the base has a slot for accommodating the raised gripping section.

15. Container of claim 10, wherein the first and second attachment means cooperate such that the intermediate support, presenting a first face to a user when the container is opened, can be withdrawn from the base, then placed in a geometrical configuration pivotable through 180° around the pin and reinserted in the cavity and to present the opposed face to the user.

16. Container of claim 1, wherein the hinge is disposed on lateral walls of the lid and base, and the base has the hollow housing having the second attachment means disposed on each of the opposed transverse walls of the base, the hollowing housing having slots being positioned symmetrically with respect to a median plane of the hinge, such that the intermediate support, equipped with a raised gripping section, can be positioned facing either side of the hinge, thereby accommodating left and right-handed users.

17. Container of claim 16, wherein the hollow housing is equipped with a projection which has a shape corresponding to the shape of the raised gripping section of the intermediate support, and which is positioned such that when the hollow part is attached to the base, the hollow part is housed in a slot in an end wall which is not used to accommodate the raised gripping section of the intermediate support.

18. Container of claim 10, wherein the hinge is disposed on a lateral wall of the base and a lateral wall of the lid, the base is equipped with a clasp positioned opposite the hinge, in a median plane of the hinge, and the second attachment means is positioned on the lateral wall of the base on which the hinge is disposed, in the median plane of the hinge.

19. Container of claim 10, wherein the hinge is disposed on a lateral wall of the base and a lateral wall of the lid, the base is equipped with a clasp positioned opposite the hinge, in a median plane of the hinge, and the second attachment means is positioned on the transverse wall of the base at a distance halfway between the hinge and the clasp.

20. Container of claim 1, wherein the hinge connects a lateral wall of the base to the lid.

* * * * *

. . . . . .

UNITED STATES PATENT AND TRADEMARK OFFICE

CERTIFICATE OF CORRECTION

PATENT NO. : 7,810,644 B2
APPLICATION NO. : 11/615264
DATED : October 12, 2010
INVENTOR(S) : Fraillon It is certified that error appears in the above-identified patent and that said Letters Patent is hereby corrected as shown below:

Title page, please correct the Assignee information as follows:

(73) Assignee: Change "Alcan Packaging Beauty Services, Gennevilliers, Gtsmvr" to
--Alcan Packaging Beauty Services, Gennevilliers, France--

Signed and Sealed this
Thirty-first Day of May, 2011

David J. Kappos

David J. Kappos
*Director of the United States Patent and Trademark Office*